United States Patent [19]

Zöllner et al.

[11] 3,962,068

[45] June 8, 1976

[54] METAL ANODE FOR ELECTROCHEMICAL PROCESSES

[75] Inventors: Dieter Zöllner; Christine Zöllner, both of Schwaig near Nurnberg; Konrad Koziol, Rothenbach a. d. Pegnitz, all of Germany

[73] Assignee: Messrs. C. Conradty, Germany

[22] Filed: Mar. 13, 1974

[21] Appl. No.: 450,834

[30] Foreign Application Priority Data

Mar. 14, 1973 Germany ..... 2312563

[52] U.S. Cl. ..... 204/290 F; 204/290 R

[51] Int. Cl.[2] ..... C25B 11/08; B01K 1/00; C25B 1/00

[58] Field of Search ..... 204/290 F, 290 R

[56] References Cited

UNITED STATES PATENTS

| | | | |
|---|---|---|---|
| 3,451,856 | 6/1969 | Fraase et al. | 136/120 FC |
| 3,491,014 | 1/1970 | Bianchi et al. | 204/242 |
| 3,649,485 | 3/1972 | Chisholm | 204/95 |
| 3,711,397 | 1/1973 | Martinsons | 204/290 F |
| 3,801,490 | 4/1974 | Welch | 204/290 F |
| 3,804,740 | 4/1974 | Welch | 204/290 R |

FOREIGN PATENTS OR APPLICATIONS

| | | | |
|---|---|---|---|
| 1,506,040 | 12/1967 | France | 204/290 F |
| 77,963 | 12/1970 | Germany | 204/290 F |

*Primary Examiner*—F. C. Edmundson
*Attorney, Agent, or Firm*—McGlew and Tuttle

[57] ABSTRACT

A metal anode for electrochemical processes, particularly for electrolytic processes, is provided with a metal resistant to the electrolysis medium and with an active cover layer applied thereon and comprising crystalline structures of the type $Me_A(I)_{approx.\ 0.4}Me_B(I)_{approx.\ 0.1}Pt_3O_4$, with $Me_A$ representing Li, Na, K, and $Me_B$ representing Tl and Ag.

6 Claims, No Drawings

METAL ANODE FOR ELECTROCHEMICAL PROCESSES

BACKGROUND OF THE INVENTION

1. Field of the Invention

The present invention relates to a metal anode for electrochemical processes, particularly for electrolytic processes, consisting of a metal resistant to the electrolysis medium and an active cover layer applied thereon, said layer containing the substances facilitating the electrode process.

2. Prior Art

Technical anode materials have to meet a number of requirements. For reasons of durability, the anode material must be sufficiently corrosion-resistant, and it must also be possible to carry out the anode process at sufficiently high speed. In the case of coated electrodes, the electron conductivity of the anode core and the surface layer, due to energy reasons, must be high and the excess voltage of the anode process must be low. Possible corrosion products of the anode may not disturb the normal operating course of the electrolytic process. Furthermore, the anode material should of course be inexpensive.

German patent application No. 1,813,944, published for inspection, describes a metal anode having an active cover layer on the basis of non-daltonoid, metallic conductive compounds of the type $Me(I)_{approx.\ 0.5}Pt_3O_4$, with Me(I) representing monovalent metals, e.g. Li or Na. Besides these materials, the cover layer may still contain binders, stabilizers and materials improving conductivity, e.g. TiC and/or TiN. The base member (core) of the anodes in this case consists either of a passivatable metal, e.g. titanium, tantalum, etc., or of a metal from the platinum group, or of a plated metal, e.g. copper/titanium, copper/tantalum, copper/-platinum metal, titanium/platinum metal, tantalum/-platinum metal, etc.

In this case of the cubic crystallizing compounds of the type $Me(I)_{approx.\ 0.5}Pt_3O_4$, the platinum atoms are squared planar and are surrounded by four oxygen atoms, and the coordination squares are stacked above one another as in the column structure. A platinum-platinum-chains obtained in this way are oriented in all three spatial directions. The individual platinum-platinum-chains are bonded through common oxygen atoms. In the centers of the oxygen cubes existing by the connection remains space for one Me(I)-cation. This bonding principle already provides for very short metal-metal-spacings, so that for each individual case the influence of the metal-metal-bond can only be assessed with great difficulty. In the case of the alkali metal platinates, the reduction of the alkali content, which leads to an increase of the formal oxidation stage of the platinum, appears to increase the platinum-platinum-bond proportions.

However, it is a prerequisite that the radii of the monovalent ions are not too large for the free gate locations to be occupied in size of about 1.2 A. This value is within the range of the ion radii of potassim, silver(I) and thallium(I), whereas the ion radii of lithium and sodium are smaller.

DESCRIPTION OF PREFERRED EMBODIMENTS OF THE INVENTION

It is, therefore, the object underlying the invention to provide a cover material for anodes which is more stable and effective by preparing and using silver platinate and thallium platinate.

According to the invention, the problem described herein is solved by providing a cover layer on a stable metal base member, which contains materials of the type $Me_A(I)_{approx.\ 0.4}Me_B(I)_{approx.\ 0.1}Pt_3O_4$, with $Me_A$ representing Li, Na, K and with $Me_B$ representing Tl and Ag.

Whereas the attempts to produce the compound $Tl_{approx.\ 0.5}Pt_3O_4$ (which so far was unknown) always resulted in $Tl_2Pt_2O_7$, chemically well stable, good electrically conductive phases were obtained when utilizing the corresponding starting silver compounds. These phases, as additive components to the so far known $Me(I)_{approx.\ 0.5}Pt_3O_4$-types of Li, Na and K, had a favorable influence on the properties in use of the anodes with respect to their life and to lowering excess voltage. One of these silver-containing compounds, which evidently also is one of the materials of good conductivity, in the Guinier photograhs showed no relationship with the known compounds of the type $Me(I)_{approx.\ 0.5}Pt_3O_4$ and $Me(I)_2Pt_2O_7$. The structure of the silver-containing compounds still is unclear. The substance was obtained by reacting $AgNO_3$ with $PtO_2.aq$ at the molar ratio of 1:1 and at a reaction period of 48 hours at 450°–500°C.

The combination $Li_{approx.\ 0.4}Ag_{approx.\ 0.1}Pt_3O_4$ as well as $Li_{approx.\ 0.4}Tl_{approx.\ 0.1}Pt_3O_4$ or, respectively, the corresponding sodium or potassium compounds, proved still more interesting. They provided coatings of excellent properties in use with a large number of chemically stable binders. Their adherence to titanium surfaces could surprisingly be improved by previous alloying-on tantalum, silver, platinum and/or palladium to the titanium base. In this connection, the presence of a surface composition TiTa30Pd05 i.e., an alloy including; beside titanium, 30% by weight of tantalum and 0.5% by weight of palladium, on the titanium side proved to be particularly favourable. However, the frequently used standard alloys TiPd02 to TiPd05 (containing 0.2-0.5% by weight of palladium) also are very well suited as the base for these new cover layer combinations.

When reacting mixtures at corresponding molar ratios, compounds were obtained which were conductive in a manner similar to metals and which, in the electrochemical test, proved to have an excellent creep strength behaviour depending on time when used as the coating material of metal anodes. For example, on the basis of titanium, about 20% the life was above the life of titanium surfaces were coated with pure $Li_{approx.\ 0.5}Pt_3O_4$, $Na_{approx.\ 0.5}Pt_3O_4$ or, respectively, $K_{approx.\ 0.5}Pt_3O_4$ or mixtures thereof. In test cells operating periods of about two years could be attained. The excess voltage behavior approximately corresponded to that of the pure compounds. The chemical stability practically did not change by the coating or doping.

EXAMPLE 1

Preparation and testing of the compound $Li_{approx.\ 0.4}Tl_{approx.\ 0.1}Pt_3O_4$ is carried out as follows. $LiNO_3$, $TlNO_3$ and $PtO_2$ at a molar ratio of 1:1:4 are slowly heated to 400°C – 600°C together with the eutectic combination LiCl/KCl in a corundum crucible and are tempered at temperatures of about 450°C, for example, for 48 hours. After processing the reaction material, the cubic crystallizing, dark grey, almost black compound of good electrical conductivity is obtained.

The material obtained is applied, together with 45 parts by weight of low-melting (approximately 500°C –

600°C) glas frit in several layers onto pre-etched titanium surfaces alloyed with palladium and, preferably, tantalum, and these are burnt at about 550°C. After the last layer has been applied, (preferably this is the fifth layer), the coated surfaces are subsequently tempered for about 1 hour at about 650°C. The thus produced metal anodes were subjected to NaCl-electrolysis and also after 8000 operating hours neither showed noticable coating losses nor a changed cell voltage. In this NaCl-electrolysis, the cell voltage 4.25 V was measured at 9 kA/m².

EXAMPLE 2

Preparation and testing of the compound $Li_{approx.\ 0.4}Ag_{approx.\ 0.1}Pt_3O_4$ is carried out as follows $LiNO_3$, $AgNO_3$ and $PtO_2$ at the molar ratio 1:1:4 are slowly heated to 450°C, together with the eutectic combination LiCl/KCl, in a corundum crucible and are maintained at this temperature for 4 days. After processing with hot nitric acid, washing and drying a black compound of the formula $Li_{approx.\ 0.4}Ag_{approx.\ 0.1}Pt_3O_4$was obtained. This compound was applied onto members of titanium with the aid of hydrochloric ruthenium chloride solution and solidified by subsequent heating to 500°C. In this way, a total of 6 layers were disposed one above another. Their content of $Li_{approx.\ 0.4}Ag_{approx.\ 0.1}Pt_3O_4$ amounted to 50 percent by weight. The anodes produced according to this process were operating in the sodium chlorate-laboratory cell at a $D_A$ = 7.5 kA/m² at 4.20 volt.

although further tests were carried out with coated titanium anodes, the cover layers of which had lower contents up to 30% of $Me_A(I)_{approx.\ 0.4}Me_B(I)_{approx.\ 0.1}Pt_3O_4$, which resulted in a favorable anode transition time, this was, however, at higher cell voltages.

It is, of course, to be understood that the present invention is, by no means, limited to the particular examples, but also comprises any modification within the scope of the appended claims.

What is claimed is:

1. Metal anode for electrochemical processes, comprising a metal resistant to the electrolysis medium and an active cover layer on the surface of said metal consisting essentially of a crystalline structure of the type $Me_A$ (I) $_{approx.\ 0.4}$ $Me_B$ $(I)_{approx.\ 0.1}$ $Pt_3O_4$, where $Me_A$ represents Li, Na, K, and $Me_B$ represents Tl and Ag.

2. A metal anode according to claim 1, in which said cover layer comprises at least 30% of substances of the formula $Me_A(I)_{approx.\ 0.4}Me_B(I)_{approx.\ 0.1}Pt_3O_4$.

3. A metal anode according to claim 1, in which the content of substances of the type $Me_A(I)_{approx.\ 0.4}Me_B(I)_{approx.\ 0.1}Pt_3O_4$ within the cover layer amounts to more that 50%.

4. A metal anode according to claim 1, in which said cover layer contains at least one member selected from the group consisting of $Li_{approx.\ 0.4}Tl_{approx.\ 0.1}Pt_3O_4$ and $Li_{approx.\ 0.4}Ag_{approx.\ 0.1}Pt_3O_4$ .

5. A metal anode according to claim 1, in which said cover layer contains, besides materials of the type $Me_A(I)_{approx.\ 0.4}Me_B(I)_{approx.\ 0.1}Pt_3O_4$, at least one of said substances selected from the group consisting of binders, stabilizers and materials for improving electrical conductivity.

6. A metal anode according to claim 1, in which the titanium base contains on its surface at least one member selected from the groups consisting of alloys TiTa-3OPdO5, TiPdO2 and TiPdO5.

* * * * *